US007532088B2

(12) United States Patent
Boulet, Jr.

(10) Patent No.: US 7,532,088 B2
(45) Date of Patent: May 12, 2009

(54) MICROSTRIP COUPLER

(75) Inventor: Stephen P. Boulet, Jr., Palatine, IL (US)

(73) Assignee: Motorola, Inc., Schaumburg, IL (US)

( * ) Notice: Subject to any disclaimer, the term of this patent is extended or adjusted under 35 U.S.C. 154(b) by 143 days.

(21) Appl. No.: 11/673,698

(22) Filed: Feb. 12, 2007

(65) Prior Publication Data

US 2008/0191814 A1 Aug. 14, 2008

(51) Int. Cl.
*H01P 5/18* (2006.01)
*H01P 3/08* (2006.01)

(52) U.S. Cl. ..... 333/116; 333/238

(58) Field of Classification Search ..... 333/109, 333/110, 112, 116, 238
See application file for complete search history.

(56) References Cited

U.S. PATENT DOCUMENTS 6,392,503 B1 5/2002 Thornton

FOREIGN PATENT DOCUMENTS

JP 02-189005 * 7/1990

* cited by examiner

*Primary Examiner*—Dean O Takaoka

(57) ABSTRACT

A microstrip coupler is provided for optimizing directivity by improving alignment of even and odd mode phase components. In one form, the microstrip coupler comprises a linear main line with a coupling line adjacent the main line. The coupling line has a non-linear configuration along a side facing the linear main line. By one approach, the non-linear configuration comprises a plurality of rectangular-shaped projections spaced along the coupling line and extending toward the main line. The rectangular-shaped projections are substantially continuously disposed along the coupling line and may be equally or variably spaced along the coupling line. The rectangular-shaped projections may also be uniform or non-uniform in size, such as, for example, by having varying height and width configurations.

7 Claims, 3 Drawing Sheets

MICROSTRIP COUPLER

TECHNICAL FIELD

This invention relates generally to microstrip directional couplers.

BACKGROUND

Microstrip directional couplers are used for various microwave and radio frequency (RF) applications, including measuring signal power in a given system. Microstrip couplers are generally comprised of coupled transmission lines, including a main power line and a coupled line, wherein energy passing through the main transmission line is coupled to the coupled transmission line. The transmission lines are deposited onto the top of a substrate of electrically insulating material, with a conductive ground layer underneath the substrate. The microstrip coupler has forward propagating waves traveling from a source (such as a power amplifier, for example) to a load (such as an antenna, for example) and reverse propagating waves traveling in the load to source direction.

Waves propagating through microstrip lines have even and odd mode components. One measure of the quality of a microstrip coupler is the directivity of the coupler. The directivity of the coupler is the ability of the coupler to discern between the forward and reflected reverse waves in the transmission system for loads presented to the source. High directivity results from the even and odd mode waves propagating at identical or closely matched phase alignment, such that the waves arrive at the output terminals in phase. The effects of high directivity lead to a higher accuracy in measuring the voltage standing wave ratio (VSWR), which represents how well a source is matched to the load. The VSWR can range from 1:1 for a perfectly matched source and load (resulting in maximum power transfer from source to load) to infinity:1 for a perfect open or short circuit. The VSWR assists in determining when a load, such as an antenna, is degrading or out of specification.

In a conventional microstrip coupler, however, the odd mode phase velocity is faster than the even mode phase velocity such that the phases are out of alignment, thereby resulting in lower directivity. Poor directivity inhibits the accurate measurement of VSWR, thus making it difficult to distinguish different VSWRs to determine when a source and load are unmatched. Therefore, it is desirable to equalize the phase fronts of the even and odd modes, thus producing higher directivity and more accurate VSWR determination, which indicates how well the amplifier is matched to the load.

Several techniques have been previously developed to attempt to equalize the phases of the even and odd modes. One such technique has been to modify the shape of both the main line and the coupling line. Incorporating periodic structures into the main line, however, can cause the main line to deviate from its standard impedance. Previously attempted techniques have also required extensive redesign and modification of existing conventional microstrip couplers, resulting in greater processing or manufacturing variations that may further impact the quality of the coupler.

BRIEF DESCRIPTION OF THE DRAWINGS

The above needs are at least partially met through provision of the microstrip coupler described in the following detailed description, particularly when studied in conjunction with the drawings, wherein.

Figure 1:
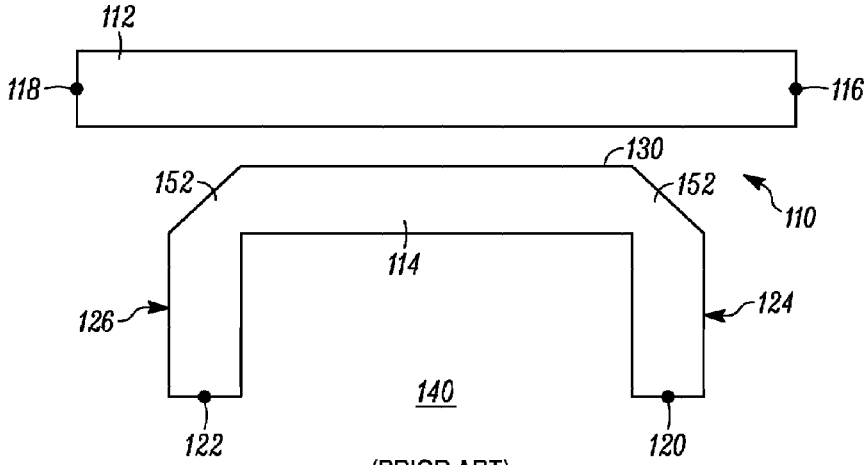
(PRIOR ART) FIG. 1
FIG. 1 comprises a top view of a known microstrip coupler.

Skilled artisans will appreciate that elements in the figures are illustrated for simplicity and clarity and have not necessarily been drawn to scale. For example, the dimensions and/or relative positioning of some of the elements in the figures may be exaggerated relative to other elements to help to improve understanding of various embodiments of the present invention. Also, common but well-understood elements that are useful or necessary in a commercially feasible embodiment are often not depicted in order to facilitate a less obstructed view of these various embodiments of the present invention. It will further be appreciated that certain actions and/or steps may be described or depicted in a particular order of occurrence while those skilled in the art will understand that such specificity with respect to sequence is not actually required. It will also be understood that the terms and expressions used herein have the ordinary meaning as is accorded to such terms and expressions with respect to their corresponding respective areas of inquiry and study except where specific meanings have otherwise been set forth herein.

DETAILED DESCRIPTION

Generally speaking, pursuant to these various embodiments, a microstrip coupler is provided for optimizing directivity by improving alignment of even and odd mode phase components. In one form, the microstrip coupler comprises a linear main line with a coupling line adjacent the main line. The main line and the coupling line each have facing sides, with the facing side of the main line having a linear configuration and the facing side of the coupling line having a non-linear configuration. Both the main line and the coupling line have opposite end portions with a port disposed on each end thereof.

The non-linear configuration of the coupling line may comprise a plurality of projections spaced along the coupling line and extending toward the linear main line. By one approach, the plurality of projections may comprise rectangular-shaped projections. The projections may be substantially continuously disposed along the coupling line. The projections may have variable or equal spacing along the coupling line and may be uniform or non-uniform in size. The projections along the coupling line increase the distance traveled by the faster odd mode wave. As a result, the odd mode phase timing becomes generally more equalized with the even mode phase timing. The even mode wave is generally unaffected by the projections on the coupling line. By compensating for the differences in the alignment of even and odd mode waves, their phases are more equalized and the microstrip coupler has greater directivity than a conventional microstrip coupler.

The microstrip coupler is thus configured to provide for optimized directivity by improving alignment of even and odd mode phase components. The improved directivity of the microstrip coupler allows for more accurate VSWR measurements to more accurately determine how well the power amplifier is matched to the load. The directivity is improved with no additional processing of the transmission lines beyond the printing of the modified coupling line and without the need for modification of the main line.

These and other benefits may become clearer upon making a thorough review and study of the following detailed description. Referring now to the drawings, and in particular to FIG. 1, a conventional microstrip coupler 110 is shown. The microstrip coupler 110 is disposed on a substrate 140 of electrically insulating material, with a ground layer (not shown) on the underside of the substrate 140. The microstrip coupler 110 comprises a main line 112 having a first port 116 disposed at one end portion of the main line 112 and a second port 118 disposed at another end portion of the main line 112. The coupler further comprises a coupling line 114 adjacent the main line 112. The coupling line 114 has a first port feed arm 124 extending from one end of the coupling line 114 and a second port feed arm 126 extending from the opposite end of the coupling line 114. The first port feed arm 124 has a third port 120 disposed thereon and the second port feed arm 126 has a fourth port 122 disposed thereon. Generally, a portion of the RF forward power flows from the first port 116 to the second port 118 of the main line 112 and a portion of the RF power is coupled into the coupling line 114 and out through the third port 120, with the portion of RF power flowing through the main line 112 being greater than the portion of RF power coupled to the coupling line 114. Similarly, a portion of the reflected power from the load connected to the second port 118 flows through the main line 112 from the second port 118 to the first port 116 and a portion of the reflected power is coupled into the coupling line 114 and out through the fourth port 122, with the portion of the reflected power flowing through the main line 112 being greater than the portion of reflected power coupled to the coupling line 114. By sampling the power at the third and fourth ports, information, such as the forward and reflected power on the main line 112, may be obtained. Both port feed arms 124, 126 have a generally linear configuration and extend generally orthogonal to the coupling line 114, with angled corner portions 152 connecting each port feed arm 124, 126 to the coupling line 114.

Figure 2:
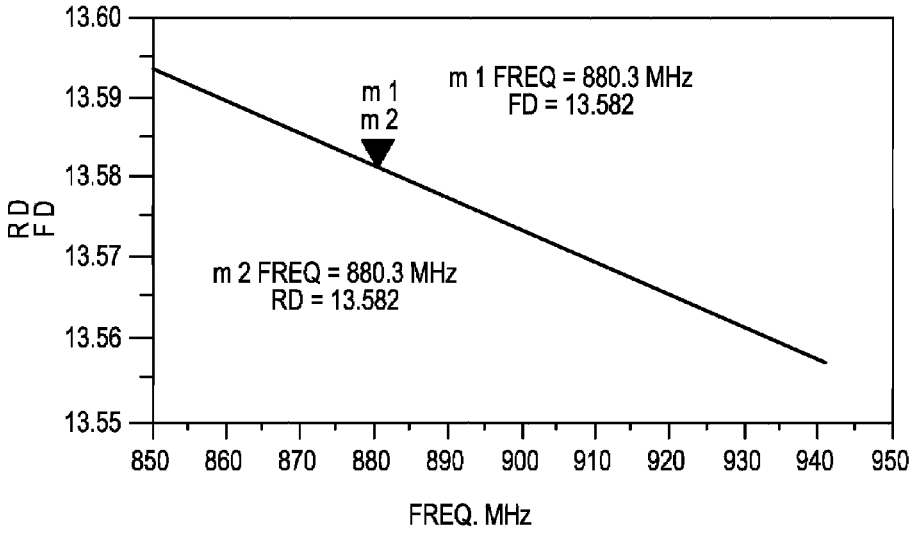
(PRIOR ART) FIG. 2
FIG. 2 comprises a forward and reverse directivity graph for the microstrip coupler of FIG. 1.

As shown, the main line 112 extends linearly between the first port 116 and the second port 118. The coupling line 114 of the conventional microstrip 110 also has a linear configuration along the side 130 adjacent the main line 112. As discussed, the conventional microstrip 110 has odd mode waves propagating at a faster phase velocity than the even mode waves, such that the phases are out of alignment, thereby resulting in lower directivity. Referring now to FIG. 2, a graph illustrates the directivity of the microstrip coupler of FIG. 1. The line labeled as m1 represents the forward directivity for the waves traveling from the source to the load and the line labeled as m2 represents the reverse directivity for the waves traveling in the reverse direction. At a frequency of 880.3 MHz, the microstrip coupler has a forward directivity of 13.582 decibels and a reverse directivity of 13.582 decibels, such that the m1 and m2 lines are superimposed on each other.

Figure 3:
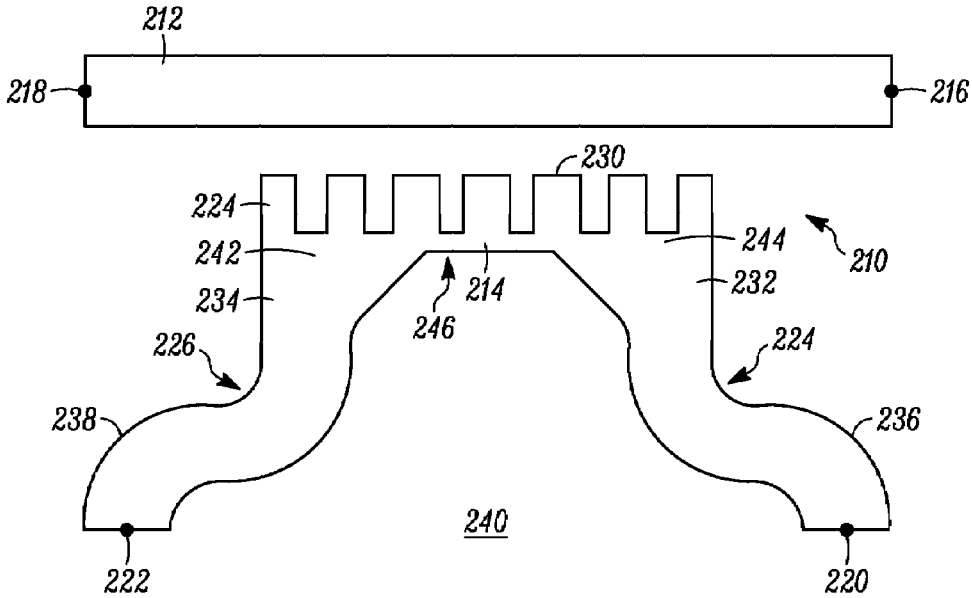
FIG. 3 comprises a top view of a first embodiment of a microstrip coupler as configured in accordance with various embodiments of the invention.

Referring now to FIG. 3, an improved microstrip coupler 210 is shown. Similar to the microstrip coupler 110 shown in FIG. 1, this coupler 210 comprises a main line 212 having a first port 216 disposed at one end portion and a second port 218 disposed at the other end portion of the main line 212. The main line 212 extends generally linearly between the two ports 216, 218. Forward waves travel from the first port 216 to the second port 218 along the main line 212 and reverse waves travel from the second port 218 to the first port 216 along the main line.

A coupling line 214 is adjacent the main line 212. The coupling line has a first port feed arm 224 extending from one end 244 thereof, with the first port feed arm 224 having a third port 220. A second port feed arm 226 extends from the opposite end 242 of the coupling line 214 and has a fourth port 222. The third port 220 receives the forward wave (traveling from the first port 216 to the second port 218 along the main line 212) and the fourth port 222 receives the reverse wave (traveling from the second port 218 to the first port 216 along the main line 212). The main line 212 and the coupling line 214 of the microstrip coupler 210 are disposed on a substrate 240 of electrically insulating material.

As shown in FIG. 3, each port feed arm 224, 226 has a generally non-linear configuration. Upper portions 232, 234 of the first port feed arm 224 and second port feed arm 226 respectively that are adjacent the coupling line 214 extend generally transverse to the coupling line 214. Lower portions 236, 238 of the first port feed arm 224 and second port feed arm 226 respectively are curved and extend away from the upper portions 232, 234 so that the arms have a generally S-shaped configuration. By another optional approach, the first port feed arm 224 and the second port feed arm 226 may contain a right angle bend therein, such that the lower portions 236, 238 extend away from the upper portions 232, 234. The upper portions 232, 234 of each arm 224, 226 adjacent the coupling line 214 are generally wider, with each port feed arm 224, 226 narrowing toward the lower portions 236, 238, with the third and fourth ports 220, 222 being located on the narrower lower portions 236, 238.

An improved feature of this coupler 210 is the non-linear configuration on the coupling line 214 along a side 230 facing the linear main line 212. The non-linear configuration of the coupling line 214 comprises a plurality of projections 224 extending toward the main line 212, with the projections 224 having a generally rectangular shape. The coupling line 214 of the microstrip coupler 210 of FIG. 3 has seven rectangular-shaped projections 224 extending therefrom, although other quantities of projections are contemplated. In this embodiment, the rectangular-shaped projections 224 of the coupling line 214 are substantially continuously disposed along the coupling line 214, such that there are no extended gaps between each projection. Further, the rectangular-shaped projections 224 are equally spaced along the coupling line 214 in this microstrip coupler 210 such that each rectangular-shaped projection 224 is generally equally spaced from an adjacent rectangular-shaped projection 224. By one approach, the rectangular-shaped projections 224 may be uniform in size or have at least one uniform size parameter. As shown in FIG. 3, the rectangular-shaped projections 224 are all generally the same height. In addition, the rectangular-shaped projections 224 may have at least one non-uniform size parameter, such as the varying widths of each projection 224. As shown in FIG. 3, the outer projections are generally narrower than the remaining projections, although other width variations and configurations are possible. The main line 212 of this microstrip coupler 210 is the same as the linear main line 112 of the conventional microstrip coupler 110 shown in FIG. 1. The coupling line 214 includes a linear side portion 246 opposite the projections 224 of the coupling line 214, with the linear side portion 246 extending between the port feed arms 224, 226.

Figure 4:
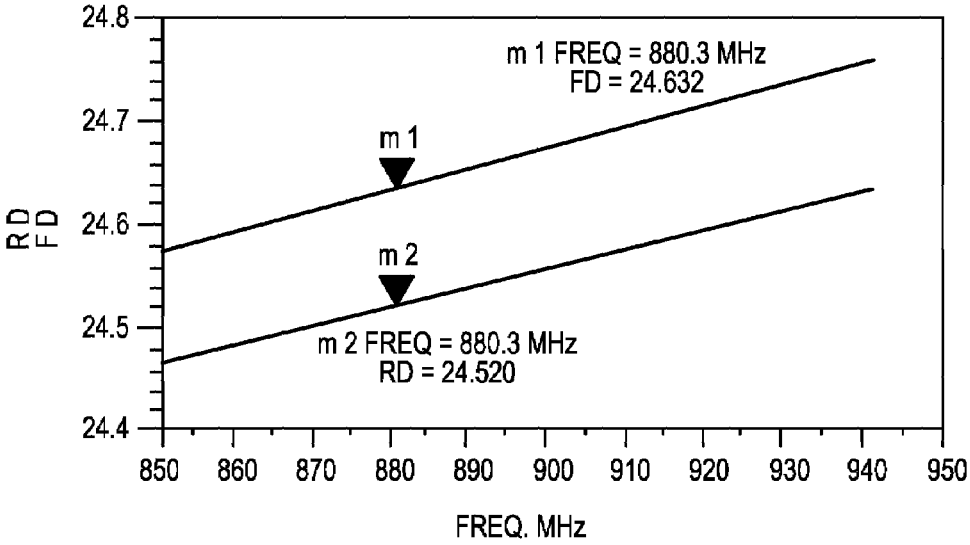
FIG. 4 comprises a forward and reverse directivity graph for the microstrip coupler of FIG. 3.

As discussed, the phases of the even and odd modes are generally unequal in a conventional microstrip coupler, such as the microstrip coupler 110 of FIG. 1. The rectangular-shaped projections 224 along the coupling line 214 of the improved microstrip coupler 210 increase the distance traveled by the faster odd mode wave. Therefore, due to the plurality of rectangular-shaped projections 224, the odd mode phase timing is reduced and becomes generally more equalized with the even mode phase. By compensating for the differences in the alignment of the even and odd mode phases, the microstrip coupler 210 has a higher directivity than the conventional microstrip coupler 110. This is illustrated by the graph of FIG. 4. Again, the line labeled m1 represents the forward directivity of the microstrip coupler and the line labeled m2 represents the reverse directivity of the microstrip coupler. At the same frequency of 880.3 MHz as measured in the graph of FIG. 2 for the conventional microstrip coupler 110 of FIG. 1, the modified microstrip coupler 210 of FIG. 3 has an improved forward directivity of 24.632 decibels and an improved reverse directivity of 24.520 decibels.

Figure 5:
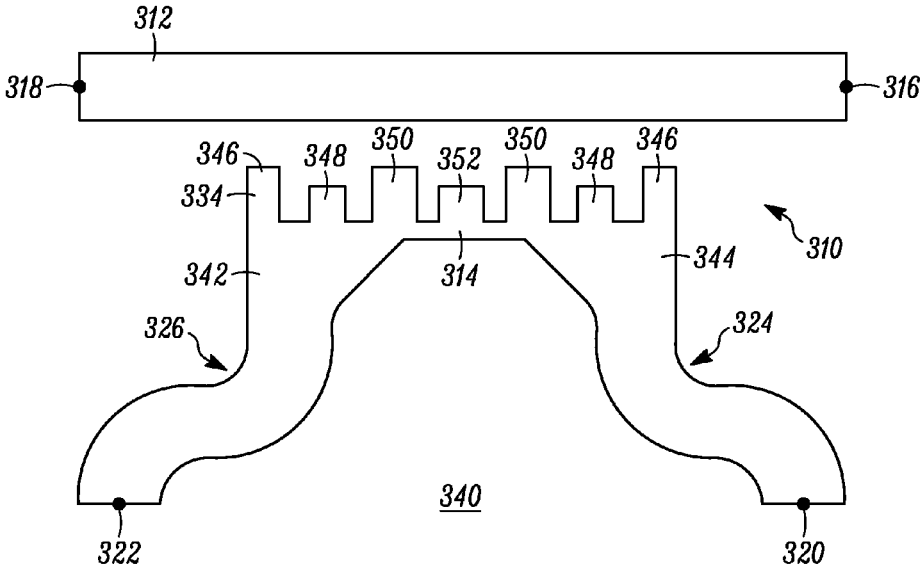
FIG. 5 comprises a top view of a second embodiment of a microstrip coupler as configured in accordance with various embodiments of the invention.

Referring now to FIG. 5, a second embodiment of an improved microstrip coupler 310 is shown. The microstrip coupler 310 has generally the same configuration as the microstrip coupler 210 shown in FIG. 3, however the configuration of the rectangular-shaped projections on the coupling line has been modified. Again, a main line 312 having two ports 316, 318 disposed thereon is adjacent a coupling line 314. The coupling line 314 has two port feed arms 324, 326 extending from respective ends 344, 342 thereof, with a third port 320 disposed on the first port feed arm 324 and a fourth port 322 disposed on the second port feed arm 326. The coupling line 314 has a plurality of rectangular-shaped projections 334 extending therefrom. The main line 312 and the coupling line 314 of the microstrip coupler 310 are disposed on a substrate 340 of electrically insulating material. The main line 312 of the microstrip coupler 310 is the same as that of the conventional microstrip coupler 110 of FIG. 1.

In this embodiment, as with the microstrip coupler 210 of FIG. 3, the rectangular-shaped projections 334 are substantially continuously disposed along the coupling line 314 such that there are no extended gaps between each projection. The spacing of the rectangular-shaped projections 334 is variable along the coupling line 314, such that the spacing between a pair of adjacent projections may vary from the spacing between another pair of adjacent projections. In addition, the rectangular-shaped projections 334 are generally non-uniform in size, such that adjacent projections may be of different sizes. As shown in FIG. 5, the rectangular-shaped projections 334 extend to varying height lines and are a variety of widths. In addition, each projection 334 may have side edges of varying lengths. As shown, the rectangular-shaped projections 334 are generally symmetrical about the center projection 352, although other configurations are contemplated. The outer rectangular-shaped projections 346 are narrower and extend higher than others of the rectangular-shaped projections. The second set of projections 348 in from the outer projections 346 are slightly wider and shorter than the outer projections 346, with sides of the projections 348 having different lengths. The third set of projections 350 in from the outer projections 346 extend above the second set of projections 348 and are slightly wider than the second set of projections 348. The center projection 352 is the shortest of the plurality of rectangular-shaped projections 334. Other height and width variations and configurations for the plurality of rectangular-shaped projections 334 are possible.

Figure 6:
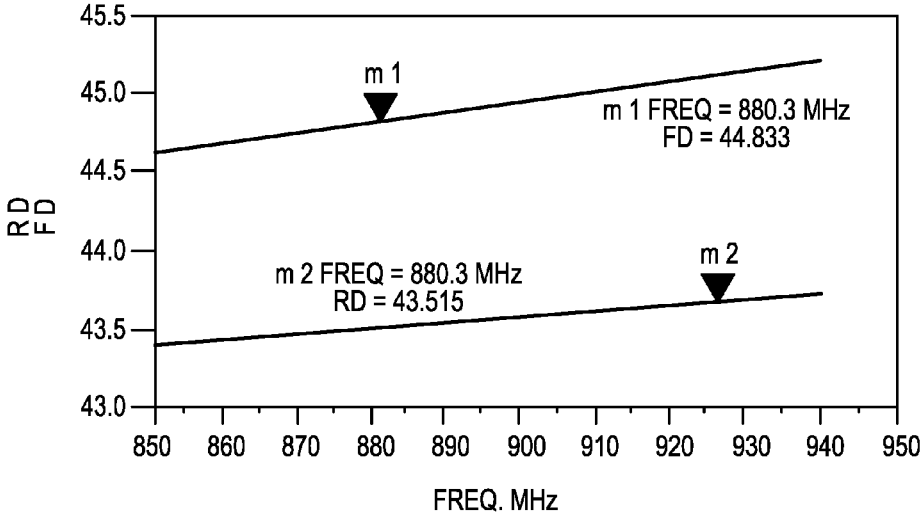
FIG. 6 comprises a forward and reverse directivity graph for the microstrip coupler of FIG. 5.

Again, due to the plurality of rectangular-shaped projections 334 along the coupling line 314, the odd mode phase timing is reduced and becomes generally more equalized with the even mode phase, thus improving the directivity of the microstrip coupler 310 as shown in FIG. 6. Again, the line labeled m1 represents the forward directivity of the microstrip coupler and the line labeled m2 represents the reverse directivity of the microstrip coupler. At the same frequency of 880.3 MHz as measured in the graphs of FIGS. 2 and 4, the modified microstrip coupler 310 of FIG. 5 has an improved forward directivity of 44.833 decibels and an improved reverse directivity of 43.515 decibels. The improved directivity for the microstrip coupler 310 results from a more exact equalization of the even and odd mode wave fronts as compared to the previous configurations.

Those skilled in the art will recognize that a wide variety of modifications, alterations, and combinations can be made with respect to the above described embodiments without departing from the spirit and scope of the invention, and that such modifications, alterations, and combinations are to be viewed as being within the ambit of the inventive concept.

I claim:

1. A microstrip coupler for optimizing directivity by improving alignment of even and odd mode phase components, the microstrip coupler comprising:

a main line having opposite end portions;

a first port disposed at one of the end portions of the main line and a second port disposed at the other end portion;

a coupling line having opposite end portions, the coupling line adjacent the main line and having port feed arms comprising curved portions, with one port feed arm extending from one end portion of the coupling line and having the third port disposed thereon and with another port feed arm extending from the other end portion of the coupling line and having the fourth port disposed thereon; and wherein a side of the main line that faces the coupling line has a linear configuration and a side of the coupling line that faces the main line has a non-linear configuration.

2. The microstrip coupler of claim 1 wherein the non-linear facing side of the coupling line comprises a plurality of projections extending toward the main line.

3. The microstrip coupler of claim 2 wherein the plurality of projections comprise rectangular-shaped projections.

4. The microstrip coupler of claim 1 wherein the non-linear configuration comprises a generally S-shaped configuration.

5. The microstrip coupler of claim 1 wherein each port feed arm comprises wider portions adjacent the coupling line and narrower portions along which the port is disposed.

6. The microstrip coupler of claim 1 wherein the coupling line includes a linear side portion opposite the non-linear side and extending between the port feed arms.

7. The microstrip coupler of claim 1 wherein the main line and the coupling line are disposed on a substrate of electrically insulating material.

* * * * *